United States Patent [19]

Harbeck

[11] 4,397,057

[45] Aug. 9, 1983

[54] APPARATUS FOR CLEANING CARPETS AND THE LIKE

[75] Inventor: Martin E. Harbeck, Anderson, S.C.

[73] Assignee: The Singer Company, Stamford, Conn.

[21] Appl. No.: 301,081

[22] Filed: Sep. 11, 1981

[51] Int. Cl.[3] ..... A47L 11/34

[52] U.S. Cl. ..... 15/321; 15/339; 219/322; 219/331

[58] Field of Search ..... 15/321, 339; 219/296, 219/308, 309, 310, 316, 322, 328, 331; 137/341; 222/146 H, 146 HE; 239/135, 136; 134/90, 107

[56] References Cited

U.S. PATENT DOCUMENTS

| | | | |
|---|---|---|---|
| Re. 27,792 | 10/1973 | Howerin et al. | 15/321 |
| 3,699,607 | 10/1972 | Putt | 15/320 |
| 3,846,615 | 11/1974 | Athey et al. | 219/322 X |
| 3,896,521 | 7/1975 | Parise | 15/321 |
| 4,015,589 | 4/1977 | Wimsatt et al. | 126/344 |
| 4,046,989 | 9/1977 | Parise et al. | 15/321 X |
| 4,068,116 | 1/1978 | McKinstry | 219/331 X |
| 4,153,968 | 5/1979 | Perkins | 15/321 |
| 4,207,649 | 6/1980 | Bates | 15/319 |
| 4,263,499 | 4/1981 | Romance | 219/331 |
| 4,308,636 | 1/1982 | Davis | 15/321 |

*Primary Examiner*—Chris K. Moore

*Attorney, Agent, or Firm*—Edward P. Schmidt; Robert E. Smith; Edward L. Bell

[57] ABSTRACT

Home or residential cleaning apparatus of the hot water or steam extraction type comprising a hot solution tank, a pump for pumping the hot cleaning solution to an applicator nozzle, a wet pick-up vacuum for extracting soiled cleaning solution, an electrical resistance heater of relatively low wattage at the bottom of the solution tank, a thermostat thermally coupled to the heater in series electrical connection therewith set to open at a temperature slightly above the boiling point of the cleaning solution to function as a safety device and also in series with the solution pump, and a signal device provided in parallel with the thermostat.

6 Claims, 5 Drawing Figures

Fig. 1.
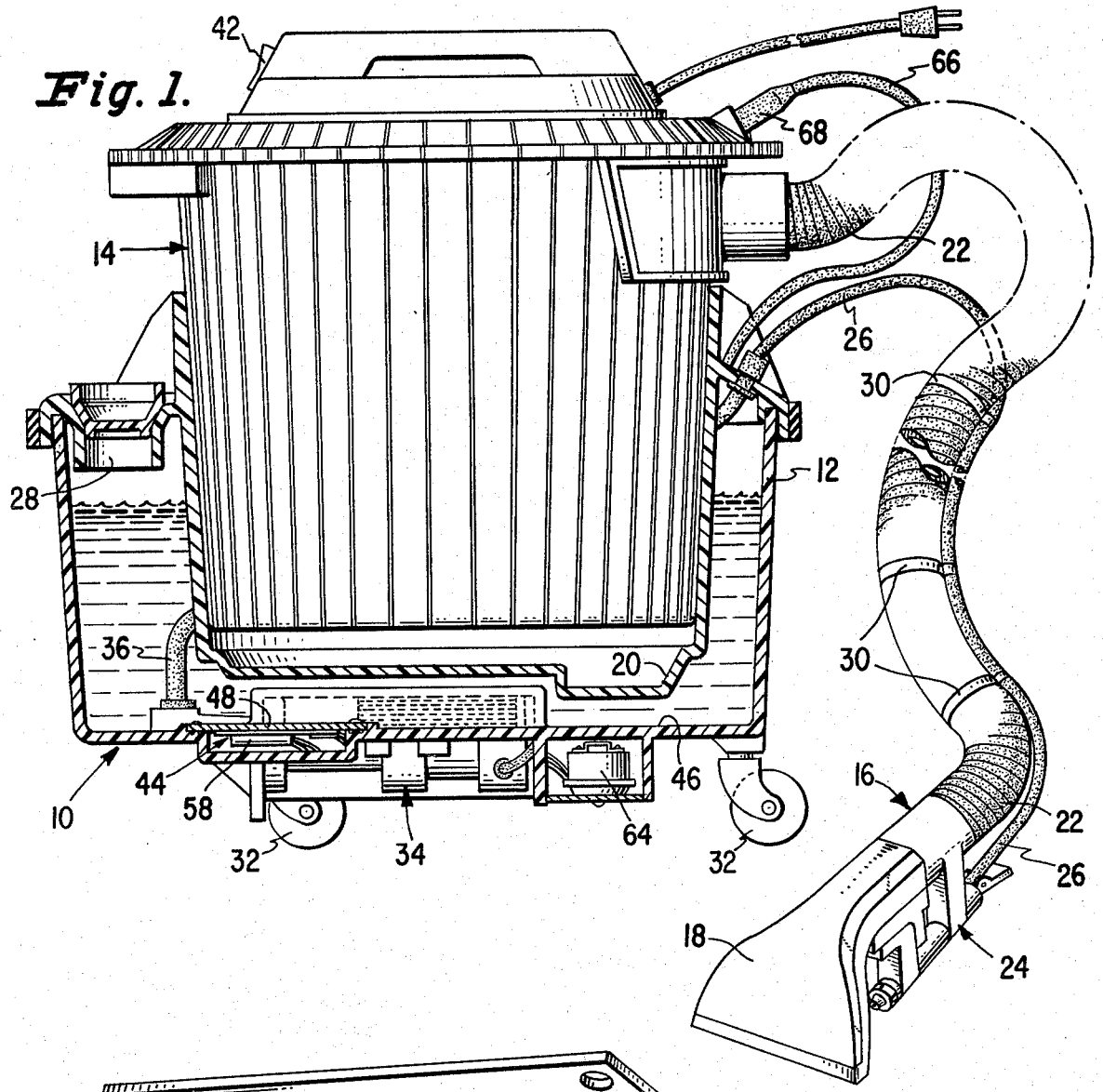
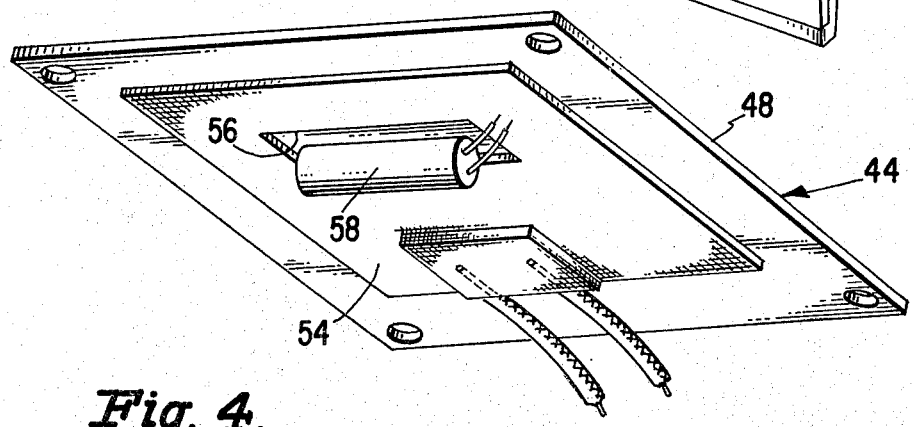
Fig. 4.

APPARATUS FOR CLEANING CARPETS AND THE LIKE

DESCRIPTION

FIELD OF THE INVENTION

This invention relates to apparatus for cleaning carpets, other floor coverings, upholstery, and the like and finds particular utility in such apparatus for home use which provides cleaning by spraying hot cleaning or rinsing solution onto the surface to be cleaned and thereafter drying the material by utilization of a suction device for removing or extracting the soiled solution from the carpet, other floor coverings, upholstery, and the like.

BACKGROUND OF THE INVENTION

Prior art devices or apparatus have been developed for cleaning carpets, other floor coverings, upholstery, and the like, by utilizing a pump for spraying a hot cleaning solution onto the carpet fibers and, following a very short time interval, extracting the soiled cleaning solution and the soil components through a suction nozzle to a wet pick-up vacuum cleaner. The cleaning solution utilized in these devices or apparatus are generally of the type that may be called detergent solutions and comprise various surfactant agents, optical brighteners, antifoam agents, and the like dispersed in a hot water solution. In addition, builders, softening agents, organic solvents and other cleaning compounds may occasionally be included. Such devices or apparatus have come to be called hot water or steam extraction cleaning apparatus although seldom is live steam actually employed.

However, because such floor covering and other materials can be permanently discolored or otherwise injured by excessive absorption of moisture, it is desirable that the cleaning solution remain in contact with the fibers for a minimal period of time. In order to enable the many compounds to do an effective cleaning job in the short interval of time allowed, it is desirable that the cleaning solution be applied while quite hot.

Such hot water or steam extraction type carpet upholstery cleaning machines have heretofore been generally separable into two distinct types or classes: commercial units which are characterized by substantial size, weight, and energy requirements, and low cost residential or home type units which are characterized by high portability, lesser size, energy requirements and weight, and generally, lower cost. While commercial type devices or apparatus have been heretofore provided with heating means for heating the cleaning solutions utilized, such home use or residential devices or appliances as have been heretofore available have not included provision for heating the cleaning solution. Instead, the household water system has been relied upon for providing sufficiently hot water for the cleaning solution and a relatively short cycle time, during which the water is expected to remain sufficiently hot.

OBJECTS OF THE INVENTION

Bearing in mind the foregoing, it is a primary object of the present invention to provide novel and improved home or residential type devices or apparatus for cleaning carpets, other floor coverings, upholstery, and the like, of the hot water or steam-extraction type, which include heating means for maintaining the cleaning solution in a heated condition for substantial periods of time, providing an increased available cycle time, more convenience to the operator, and enhanced cleaning capability, while yet retaining the portability, small size, low weight, low energy requirement, and generally low cost necessary for successful marketing for home or residential use.

Other primary objects of the present invention, in addition to each of the foregoing objects, are the provision of such devices or apparatus wherein such heating means is automatically controlled, wherein the heating means is automatically disconnected when the solution tank is empty, which further automatically signals the operator that the solution tank is empty, and which yet further automatically also then disables the hot solution pump so as to prevent any damage thereto from being run in a dry condition.

It is a feature of the present invention that all of the above objects are achieved economically and efficiently with a minimal number of added parts and in a compact and durable apparatus.

The invention resides in the combination, construction, arrangement and disposition of the various component parts and elements incorporated in improved apparatus for cleaning carpets, other floor coverings, upholstery, and the like, in accordance with the principles of this invention. The present invention with be better understood and objects and important features other than those specifically enumerated above will become apparant when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

In accordance with the present invention, home or residential cleaning apparatus of the hot water or steam extraction type for carpets, other floor coverings, upholstery, and the like, is provided comprising a hot solution tank for containing a heated cleaning solution, a pump for pumping the hot cleaning solution to an applicator nozzle and a wet pick-up vacuum for extracting soiled cleaning solution from the carpet a short period of time after the solution is sprayed onto the carpet. Preferably, the solution tank and wet pick-up vacuum are nested one within the other, the dispensing nozzle and pick-up nozzle are mounted with a common cleaning head and the cleaning head is connected with the nested solution tank/dispenser and wet pick-up vacuum/extracter by a pair of coupled conduits including flexible connecting hoses and, for floor surface use, a generally rigid wand enabling easy operator manipulation of the cleaning head.

In accordance with the present invention, the cleaning solution tank is provided with heating means for heating the cleaning solution. In accordance with one aspect of the present invention, the heating means is an electrical resistance heater of relatively low wattage sufficient to maintain the cleaning solution in a heated condition yet need not be sufficient to independently raise the temperature of the cleaning solution from, for example, room temperature, to an effective cleaning temperature. In accordance with this aspect of the present invention the energy requirements of the apparatus are maintained at a relatively modest level. In accordance with another aspect of the present invention, a thermostat is provided thermally coupled to the heater in the bottom of the solution tank and in series electrical connection with the resistance heater, with the thermostat being set to open at a temperature slightly above the boiling point of the cleaning solution. Accordingly, the thermostat will function as a safety device, disconnecting flow of electrical power to the heater when the solution tank is emptied. In accordance with yet another aspect of the present invention, the solution pump is also coupled with the thermostat, in parallel with the heater so that, upon the solution tank being emptied, the solution pump will also be disconnected, preventing damage thereto from operation in a dry or unlubricated condition and, in addition, providing the operator with an audible indication that the solution tank is empty. In a yet further aspect of the present invention, a buzzer, pilot or indicator lamp, or other signal device may be provided in parallel with the thermostat so that upon the thermostat opening, the signal device will be actuated to provide the operator with a further indication that the solution tank has been emptied.

DESCRIPTION OF THE DRAWING

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows a preferred embodiment or modification of the present invention and what is presently considered and believed to be the best mode of practicing the principles thereof and wherein:

FIG. 1 is an elevational illustration, partially in cross-section of a home or residential type device or apparatus for cleaning carpets, other floor coverings, upholstery, and the like, incorporating the novel improvements and constructed in accordance with the principles of the present invention;

FIG. 4 is an enlarged perspective illustration of the heater and thermostat assembly.

DETAILED DESCRIPTION OF THE INVENTION

Figure 2:
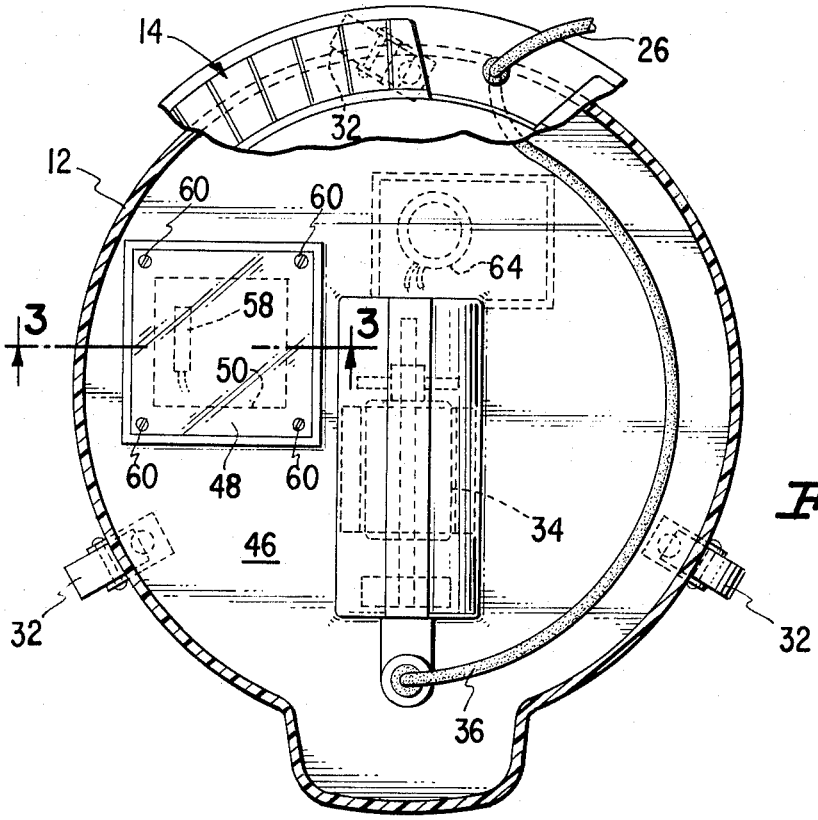
FIG. 2 is a top plan view, partially in cross-section of the apparatus of FIG. 1.
Figure 3:
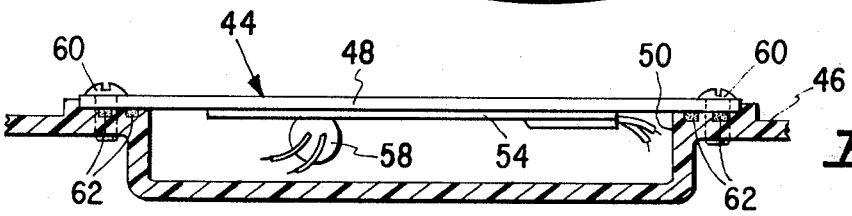
FIG. 3 is an elevational cross sectional partial view taken along line 3—3 of FIG. 2.
Figure 5:
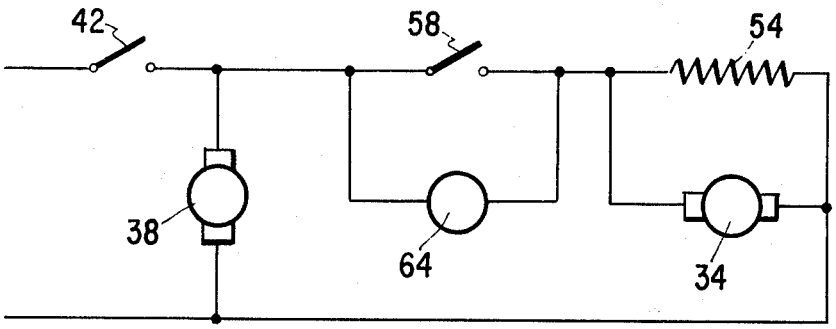
FIG. 5 is a schematic wiring diagram of the cleaning apparatus.

With reference now to the drawing, and particularly to FIGS. 1 and 2 thereof, there is shown and illustrated therein a device or apparatus for cleaning carpets, other floor coverings, upholstery, and the like, constructed in accordance with the principles of the present invention and designated generally by the reference character 10. The device or apparatus 10 comprises a solution tank portion 12, wet pick-up vacuum extraction or recovery unit 14 and conduit means 16 connecting the solution tank 12 and recovery unit 14 and a cleaning head 18. Preferably, the solution tank 12 and the wet pick-up unit or recovery tank 14 are physically mounted together, as by being piggy-backed one with the other. Accordingly, the solution tank 12 may be of generally annular configuration provided with a generally central well 20 into which the wet pick-up or recovery tank portion 14 may be nested. Similarly, the conduit means 16 may comprise f flexible, for example, corrugated, pick-up or recovery hose portion 22 connected with the pick-up unit or recovery tank 14 and with a control valve assembly 24. In the embodiment illustrated, the head 18 is directly connected with the control valve assembly 24. The illustrated head 18 is especially useful for upholstery, stairs, and the like and is shown in more detail in U.S. patent application serial No. 145,645, filed May 2, 1980 and assigned to the assignee of the instant application. For general floor cleaning, a larger floor nozzle would be generally used connected with a generally rigid wand portion (not shown) detachably mounted to the cleaning head 18 and the control valve assembly 24. Conduit means 16 also comprises a flexible tube 26 connecting the solution tank portion 12 with the valve control assembly 24. A further hose portion (not shown) connecting the control 24 with the cleaning head and carried by the wand would also be desirable when floor cleaning with a wand. Clip means 30 may be provided connecting the tube 26 with the hose 20 to piggy-back the hose 26 on the recovery hose 22. The housings for the solution tank 12, recovery tank 14, control valve 24, and cleaning head 18 may all be molded of plastic material, as may the pick-up hose 22, wand sections and solution tube portion 26. Since they are all intimately connected together, a compact lightweight, inexpensive and easily manipulated cleaning device or apparatus 10 may result.

To further aid in easy manipulation, the solution tank 12 may be provided with a plurality or preferably 3, swivel casters 32. Further, the solution tank 12 may be provided with an electrical pump, designated generally by the reference character 34 for pumping the cleaning solution contained within the solution tank 12 through an internal conduit portion 36 to connect with the tube 26 and the recovery tank 14 may be provided with an electric motor blower 38 for providing the negative pressure within the recovery tank 14 necessary to vacuum the solid cleaning solution from the pick-up nozzle in the cleaning head 18. To use the cleaner appliance 10, the operator would fill the solution tank 12 with cleaning solution, for example, a hot detergent in water mixture through a fill opening 28 and then actuate the solution pump motor 34 and the blower motor 38, as by means of an on-off switch 42. By means of the valve control 24, hot cleaning solution may be sprayed onto the carpet, or the like, by the cleaning head 18 to loosen and entrap soil, dirt, grease, and the like to be substantially immediately be vacuumed up and collected in the recovery unit or tank 14.

In order to maintain the cleaning solution within the solution tank 12 at an appropriately high temperature for effective cleaning, the solution tank 12 may be provided with an electric heater designated generally by the reference character 44 mounted with the bottom wall 46 thereof. The heater 44 perferably comprises a generally flat aluminum plate 48 spanning a slightly smaller, generally rectangular opening 50 provided in the solution tank bottom wall 46. A housing well 52 is integrally molded with the solution tank 12 beneath the heater plate 48. Bonded to the bottom surface of the heater plate 48 is an electric resistance heater 54 containing an aperture 56. A thermostat 58 is also bonded to the under surface of the heater plate 48. The plate 48 is mounted with the solution tank bottom wall 46 in a convenient manner, as by means of self tapping screws 60, or the like, and sealed against leakage therepast as by means of a gasket or silicon rubber RTV sealant beading 62 between the heater plate 48 and the solution tank bottom wall 46, such sealant may, for example, be provided within one or more grooves in such solution tank bottom wall 46.

The solution tank 12 also is provided, as by being adjacent the pump motor 3, with a signalling means, such as a buzzer 64. The thermostat 58 is connected in parallel with the buzzer 64 and in series with the heater 54. The pump motor 34 is connected in parallel with the heater 54 and, therefore, is also in series with the thermostat 58. The thermostat 58 is preferably set to be closed below the boiling temperature of water and to open somewhat above the boiling point of the cleaning solution but at a temperature sufficiently below that which the plastic of the recovery tank housing can safely withstand. Hence, when the solution pump 34 has emptied the solution tank 12, the temperature of the heater plate 48 and the thermostat 58 will rise to the opening set point of the thermostat 58, for example, 250° F. When this temperature is reached, the heater 54 and the solution pump 34 will both be turned off. Simultaneously, the buzzer 64, which when the heater 54 and pump 34 are operating is shorted by the thermostat 58 will signal the operator that the solution tank 12 is empty, since the buzzer 64 will commence buzzing when the thermostat 58 opens. The solution tank wiring and the wiring of the pick-up or recovery unit may be connected by means of a short cable 66 and plug 68.

While the invention has been described, disclosed, illustrated and shown in terms of a preferred embodiment or modification which it has assumed in practice, it is to be expressly understood that this has been done for purposes of example only and that the invention is not intended to be deemed limited thereby, and that other embodiments or modifications that may be suggested to those having the benefit of the teachings herein are intended to be reserved especially as they fall within the scope and spirit of the claims here appended.

I claim:

1. Home or residential cleaning apparatus of the hot water or steam extraction type for carpets, other floor coverings, upholstery, and the like, comprising a hot solution tank for containing a heated cleaning solution, pump means for pumping the hot cleaning solution to an applicator nozzle, wet pick-up vacuum means for extracting soiled cleaning solution and heating means at the bottom of said solution tank for heating the cleaning solution, said heating means comprising electrical resistance heater means of relatively low wattage sufficient to maintain the cleaning solution in a heated condition so that the energy requirements of the apparatus are maintained at a relatively modest level, a thermostat thermally coupled to the said heater and in series electrical connection therewith, said thermostat being set to open at a temperature slightly above the boiling point of the cleaning solution so that said thermostat may function as a safety device, disconnecting flow of electrical power to the heater when said solution tank is emptied, and said solution pump is also coupled with said thermostat, in parallel with said heater so that, upon the solution tank being emptied, the solution pump will also be disconnected.

2. Apparatus defined in claim 1 further comprising signal means provided in parallel with said thermostat so that upon the thermostat opening, said signal means will be actuated to provide the operator with a further indication that the solution tank has been emptied.

3. Home or residential cleaning apparatus of the hot water or steam extraction type comprising a hot solution tank, a pump for pumping the hot cleaning solution to an applicator nozzle, a wet pick-up vacuum for extracting soiled cleaning solution, an electrical resistance heater of relatively low wattage at a bottom of the solution tank in parallel electrical connection with said pump, and a thermostat thermally coupled to said heater and in series electrical connection to the parallel connected pump and heater and set to open at a temperature slightly above the boiling point of the cleaning solution to function as a safety device.

4. Cleaning apparatus defined in claim 3 further comprising a signal device provided in parallel electrical connection with the thermostat.

5. In a home or residential cleaning apparatus of the hot water or steam extraction type including a hot solution tank, a pump for pumping the hot cleaning solution to an applicator nozzle, and a wet pick-up vacuum for extracting soiled cleaning solution, an electrical resistance heater of relatively low wattage at the bottom of the solution tank, a thermostat thermally coupled to the heater and in series electrical connection therewith set to open at a temperature slightly above the boiling point of the cleaning solution and also in series with the solution pump, to function as a safety device.

6. In the apparatus of claim 5 wherein a signal device is provided in parallel with the thermostat.

* * * * *